US005713781A

United States Patent [19]

Castanis

[11] Patent Number: 5,713,781

[45] Date of Patent: Feb. 3, 1998

[54] DOLL CARRIER FOR MINIATURE TOY ANIMALS

[76] Inventor: Geroge Castanis, 444 Sixth Ave., New York, N.Y. 10011

[21] Appl. No.: 660,921

[22] Filed: Jun. 10, 1996

[51] Int. Cl.[6] ..... A63H 3/02; A63H 3/36

[52] U.S. Cl. ..... 446/369; 446/390

[58] Field of Search ..... 446/369, 390, 446/72, 73, 74, 98, 268

[56] References Cited

U.S. PATENT DOCUMENTS

| | | | |
|---|---|---|---|
| 1,543,351 | 6/1925 | Webb | 446/369 |
| 3,392,480 | 7/1968 | Stubbmann | 446/101 X |
| 3,789,547 | 2/1974 | Chemarin | 446/390 X |
| 3,955,312 | 5/1976 | Pugh | 446/390 X |
| 4,197,604 | 4/1980 | Nakamura | 446/72 X |
| 4,197,670 | 4/1980 | Cox | 434/273 X |
| 4,950,196 | 8/1990 | Fortune et al. | 446/73 |
| 4,954,114 | 9/1990 | Kawashima | 446/268 X |
| 5,059,149 | 10/1991 | Stone | 446/369 X |
| 5,197,885 | 3/1993 | Friedel | 446/268 X |
| 5,433,643 | 7/1995 | Pratt | 446/390 X |

FOREIGN PATENT DOCUMENTS

| | | | |
|---|---|---|---|
| 1165218 | 10/1958 | France | 446/98 |
| 583408 | 12/1946 | United Kingdom | 446/390 |
| 2110098 | 6/1983 | United Kingdom | 446/369 |

*Primary Examiner*—D. Neal Muir
*Attorney, Agent, or Firm*—Michael Ebert

[57] ABSTRACT

A doll having the figure of a girl or other human being, adapted to function as a carrier for a plurality of miniature toy animals, which may be kittens or puppies. The doll includes a pair of bendable and stretchable arms extending from the shoulders and terminating in hands. Each hand has a projecting thumb and fingers partially clenched over the palm to define a hook. The hands are positioned in opposing relation so that the hook of one hand can be intermeshed with the hook of the other to cause the hands to be clasped together to create in conjunction with the arms a cradle that is stretchable to embrace several toy animals. The doll wears a removable garment provided on either side thereof with deep pockets that lie below the cradle and accommodate additional toy animals. And a back pack strapped on the shoulders of the doll serves as a carrier for more toy animals. Thus the loaded doll presents the figure of a caring girl burdened front and back with toy animals which she has rescued.

10 Claims, 2 Drawing Sheets

FIG. 1
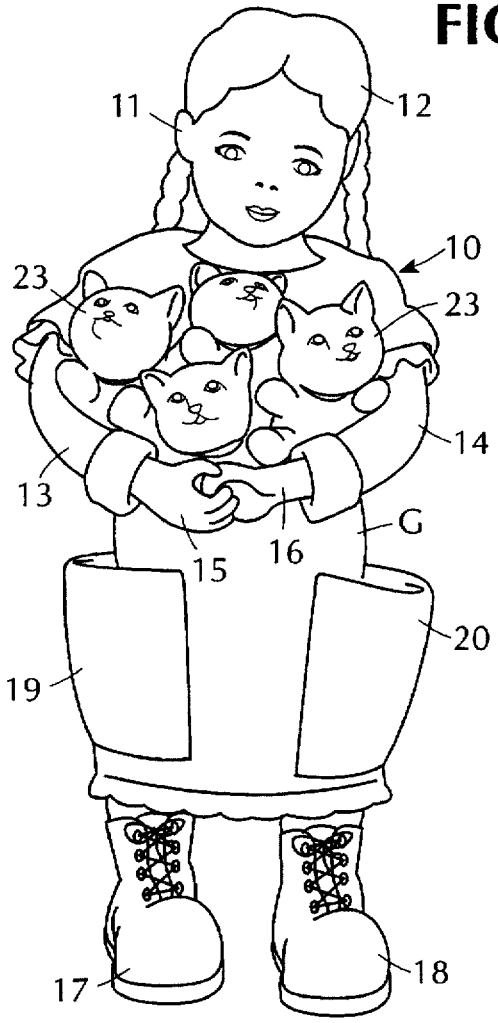
FIG. 2
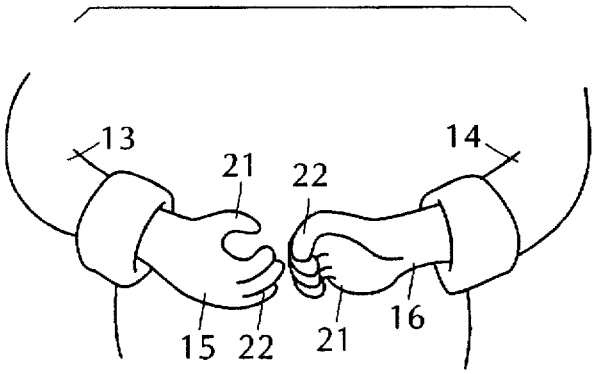
FIG. 4
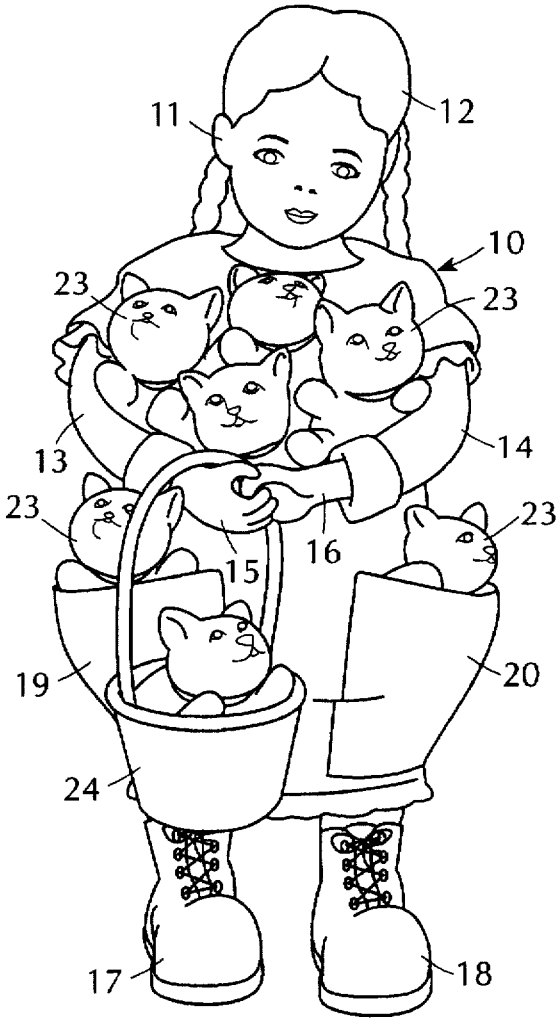
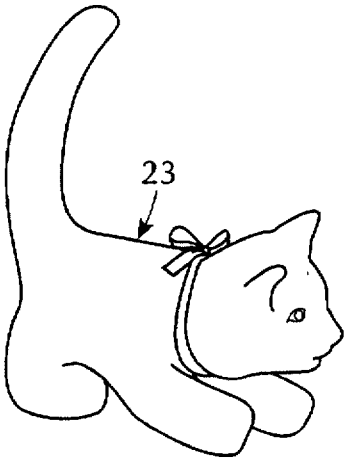
FIG. 3

DOLL CARRIER FOR MINIATURE TOY ANIMALS

BACKGROUND OF INVENTION

1. Field of Invention

This invention relates generally to dolls, and more particularly to a doll adapted to function as a carrier for miniature toy animals.

2. Status of Prior Art

A doll is a small figure of a human being, usually used as a child's toy. Among primitive peoples, dolls are used as cult objects. But in ancient Egypt, Greece and Rome, dolls of wood, clay or ivory were used not only symbolically, but also as children's play things.

In Europe in the Middle Ages, dolls served in the spread of costume styles. And such dolls brought from Europe to the American Colonies exemplified the latest European fashions. Fashion dolls remain highly popular in the United States, as evidenced by the well-known "Barbie" doll. Though fashion dolls are attractive, they offer a child who plays with them little in the way of emotional gratification.

The concern of the present invention is with dolls that are more than playthings or fashion dolls and serve to satisfy certain psychological needs of children. A child lives in a society dominated by adults, and by playing in a manner emulating adult activity, a developing child is better able to cope with the adult world.

Children are fascinated by babies and the ways in which adults tend to infants. Perhaps the most popular baby dolls are those identified by the mark Cabbage Patch Kids. The strong appeal of a Cabbage Patch Kids doll has little to do with its homely and therefore realistic appearance. What establishes an emotional rapport between the child and a "just-born" Cabbage Patch Kids doll is that the child, upon acquiring this baby, must then give it a name and fill out a birth certificate form as well as adoption papers. In this way the child does more than just acquire a baby doll, for the baby doll in this instance becomes an intimate member of the child's own family and the child is then responsible for its care.

A doll in accordance with the invention is addressed to a basic insecurity exhibited by most children, even those who have caring parents and therefore have no reason to feel uneasy. Yet nearly every child is fearful of becoming lost or of being abandoned, and while a child may have no rational grounds to justify this feeling, the child is nevertheless troubled by this possibility.

Thus a mother who takes her four-year old child to a playschool and there sits in a chair to observe her child at play, will often find that her child repeatedly looks in her direction to be sure she is still sitting in the chair and has not departed from the playschool and abandoned her child.

Because a child is sensitive to the possibility of being lost or abandoned, the child is naturally sympathetic to those who suffer this fate. Thus a child who when accompanied by a parent sees in the street a forlorn kitten who seems to have been abandoned, the child then usually urges the parent to rescue the homeless kitten.

There is currently a lively debate in political circles about the decline in our society of family values. It is generally recognized that such values as human decency and the obligation to take care of those who are less fortunate must be instilled in children by their parents and teachers, for family values are not genetically acquired.

A doll in accordance with the invention is adapted to function as a carrier for miniature toy animals, and this special doll makes it possible for a child who plays with it to vicariously experience an act of abandonment of the toy animals followed by their rescue, and thereby undergo the emotional release which accompanies this experience.

A child who is made responsible for the well-being of toy kittens or puppies put in the child's care, in the process of acting out the rescue of these toy kittens or puppies should they become abandoned, is taught family values that are otherwise difficult to instill in the child. Characteristic of play activity is the act of pretending, and the child playing with the doll pretends that the doll is herself and that the toy animals are real animals or children.

SUMMARY OF INVENTION

In view of the foregoing, the main object of this invention is to provide a doll adapted to function as a carrier for miniature toy animals, such as kittens or puppies or other young animals which are defenseless and require care.

The psychological and social benefit afforded by a doll in accordance with the invention in which the doll is a figure of a girl or other human being acting as the guardian of the toy animals is that in playing with the doll, an emotional rapport is established between the doll figure with whom the child personally identifies and the young toy animals in the care of the doll which symbolize children. This makes it possible for the child in the course of play to simulate the human experience of abandonment and rescue, and in the process of doing so, to have human values instilled in the child. The play activity also acts to relieve whatever anxiety the child may feel in regard to the possibility of being lost or abandoned, for the child is thereby assured that should she become lost or abandoned, she too will be rescued.

More particularly, an object of the invention is to provide a doll capable of embracing and cradling several small toy animals and thereby protectively carrying these animals.

Also an object of the invention is to provide a garment for a doll and a back pack both of which are capable of carrying additional toy animals, thereby enlarging the animal-carrying capacity of the doll.

Briefly stated, these objects are attained by a doll having the figure of a human being such as a girl, adapted to function as a carrier for a plurality of miniature toy animals which may be kittens or puppies. The doll includes a pair of bendable and stretchable arms extending from the shoulders and terminating in hands. Each hand has a projecting thumb and fingers partially clenched over the palm to define a hook.

The hands are positioned in opposing relation so that the hook of one hand can be intermeshed with the hook of the other to cause the hands to be clasped together to create in conjunction with the arms a cradle that is stretchable to embrace several toy animals. The doll wears a removable garment provided on either side thereof with deep pockets that lie below the cradle and accommodate additional toy animals. And a back pack strapped on the shoulders of the doll serves as a carrier for more toy animals. Thus the loaded doll presents the figure of a caring girl burdened front and back with the toy animals which she has rescued.

BRIEF DESCRIPTION OF DRAWINGS

For a better understanding of the invention, as well as further features thereof, reference is made to the detailed description thereof to be read in connection with the annexed drawings wherein:

FIG. 1 is a front perspective view of a doll in accordance with the invention in which the hands of the doll are clasped together to cradle several toy animals, the doll wearing a garment having side pockets;

FIG. 2 is a separate view of the hands of the doll;

FIG. 3 shows one of the toy animals;

FIG. 4 illustrates the doll with the side pockets of the garment loaded with small animals;

DETAILED DESCRIPTION OF INVENTION

Figure 6:
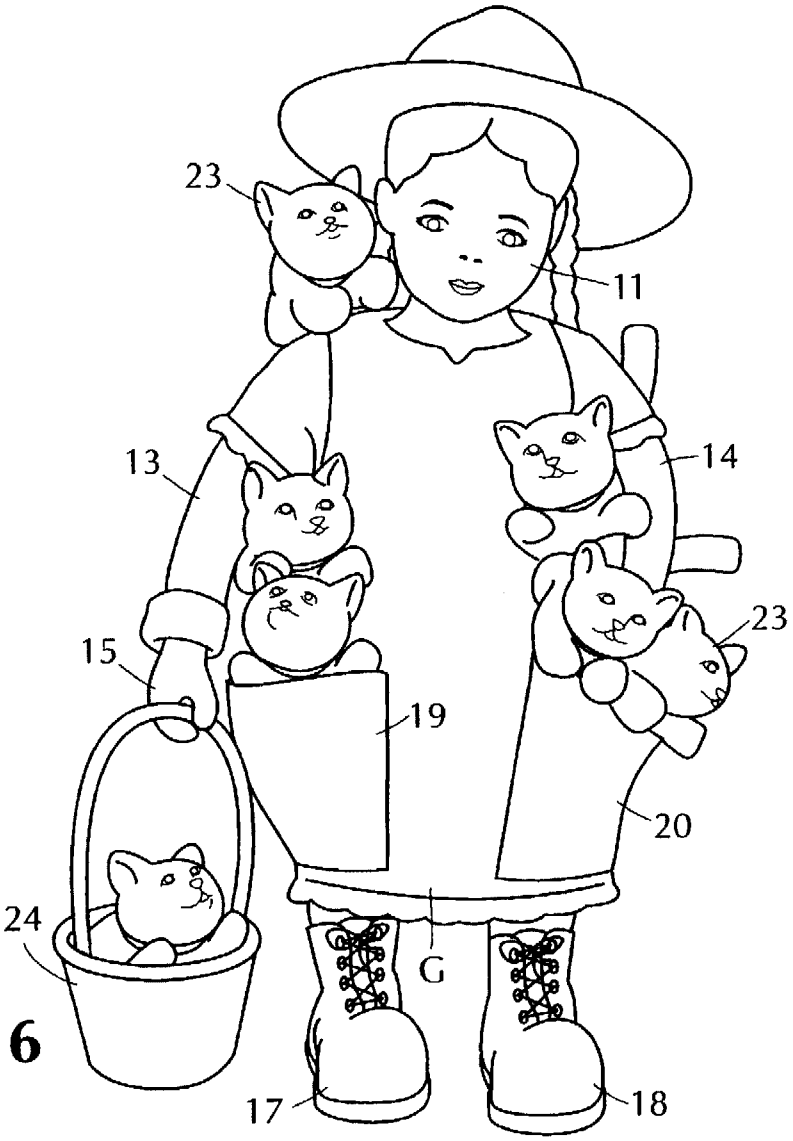
FIG. 6 shows the doll with its arms extending downwardly, one hand carrying a loaded basket.

Referring first to FIG. 1, illustrated therein is a doll 10 having the figure of a girl. In practice the doll may have other human forms, such as that of a boy or of an adult mother.

The girl doll 10 is provided with a head 11 having a nose, mouth and eyes, and hair 12 which include pigtails. Extending from the shoulders of the girl is a pair of arms 13 and 14 to which are joined hands 15 and 16. The girl has fitted on her feet a pair of boots 17 and 18, and is wearing a garment G having large open side pockets 19 and 20.

Arms 13 and 14 are bendable and stretchable, and for this purpose may be formed of a tube fabricated of elastomeric yarns, such as latex. The tubular arms are stuffed with a soft compressible material, such as cotton batting or resilient foam plastic material, as for example polyurethane. Hands 15 and 16 are molded or otherwise formed of high strength synthetic plastic material, such as PVC or polypropylene.

As best seen in FIG. 2, each hand is configured to form a projecting thumb 21 and four abutting fingers 22 which are partially clenched over the palm to create a hook which is laterally accessible through the end opposite the thumb.

Hands 15 and 16 are joined to arms 13 and 14 so that they are oriented in opposition to each other, as shown in FIG. 2. Hence as shown in FIG. 1, the fabric arms 13 and 14 may be bent inwardly and the hook of one hand may be intermeshed with the hook of the other so that hands 15 and 16 are then snugly clasped together.

When the hands are so interlinked, they create in conjunction with arms 13 and 14 a cradle which is stretchable to embrace as many miniature toy animals 23 as one can fit within the confines of the stretchable cradle.

Each toy animal 23, as illustrated, is the figure of a kitten, which as shown separately in FIG. 3 has four paws and a tail. The toy animal is of soft, plush construction and in practice has a compressible inner stuffing or a flexible foam plastic care. Or the miniature toy animals may be the figure of a small puppy or other young animal, such as a bear cub or piglet.

Because the miniature toy animals are soft and compressible, a large number of these animals may be squeezed together and embraced within the stretchable cradle, with the heads of the animals all exposed and pointing in different directions. There is no need for all of the toy animals to look alike or to have the same size, for in practice there may be an assortment of toy animals having different sizes and appearances. Thus in the case of kittens, their coats may be white, black or have other coat colors. Also what is shown cradled in FIG. 1 could be a litter of just-born kittens abandoned by their mother cat and thereafter rescued by the girl doll.

Garment G is utilitarian in style and may be fabricated of denin, or other work clothes material. And it may also be in the form of overalls, for the girl doll has a mission to accomplish which is to save abandoned kittens from destitution. The girl therefore is wearing work boots so that she can tramp in search of these kittens in back alleys or wherever else the lost kittens are wandering. Garment G is removable and may be provided with VELCRO fabric fasteners for this purpose, so that the garment may be replaced by other garments having different styles.

The deep pockets 19 and 20 in either side of the garment are below the cradle, and as shown in FIG. 4, these pockets may be stuffed with additional small toy kittens 23. And the doll also has looped over one arm, the hoop of a wicker basket 24 which is loaded with additional toy kittens 23.

Figure 5:
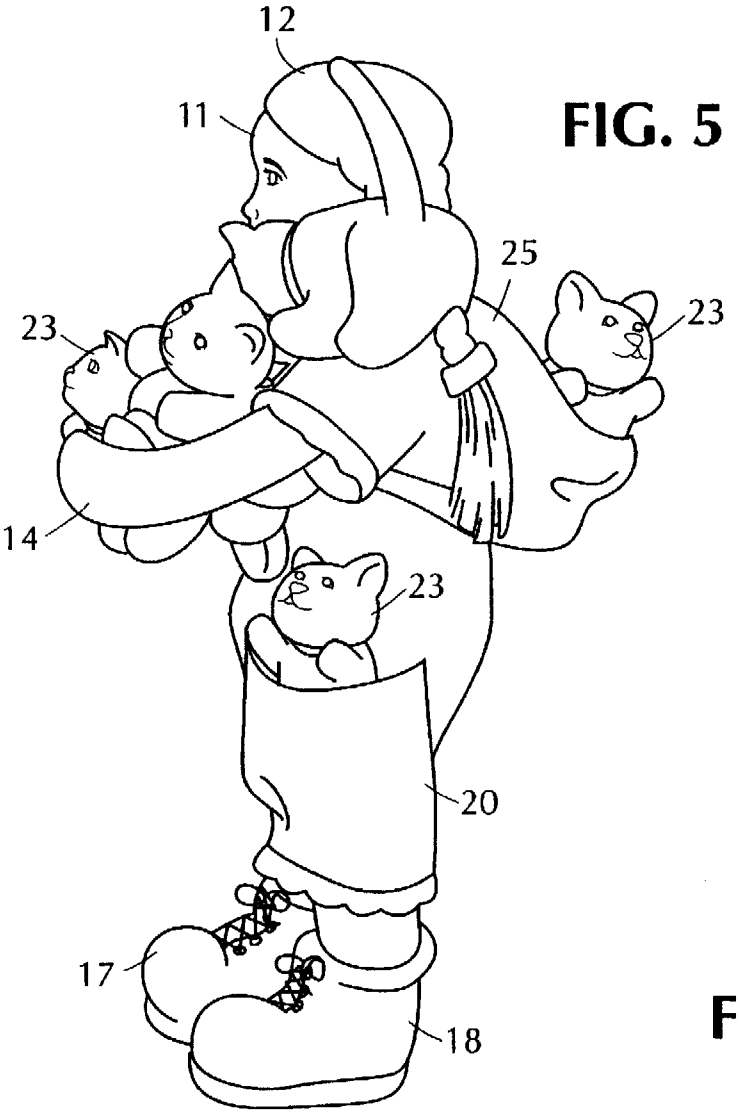
FIG. 5 is a side view of the doll, showing the loaded back pack supported on its shoulders.

As best seen in FIG. 5, strapped on the shoulders of the doll is a fabric back pack 25 which has a deep rear pocket in which are received still more toy animals whose heads peep out of this pocket. Thus the girl doll is burdened, front and back, with as many miniature toy kittens as she is able to rescue and carry, and take care of without neglecting any one kitten.

It is not necessary in playing with the doll, that the hands be clasped together to create a cradle. Thus as shown in FIG. 6, the hands may be unclasped, the hook of one hand then holding the hoop of the wicker basket 24 loaded with toy animals. In FIG. 6 in which the hands are unclasped, one arm holds a basket carrying toy animals. There are also toy animals held under the downwardly-extending other arm, and toy animals loading the side pockets of garment G. There is also a toy animal carried on one shoulder of the girl. And the girl is also wearing a straw hat 26 to protect her from the sun as she forages for lost kittens.

Thus a doll in accordance with the invention which functions as a carrier for small animals, makes it possible for a child playing with this doll to improvise a play program in which the child who identifies with the doll then proceeds to satisfy certain psychological needs in regard to anxieties which trouble the child.

In doing so, the doll-child assumes the role of the rescuer of the miniature young animals who are surrogates for lost or abandoned children. Before rescuing the small animals, the child can play with them separately and get to know them and give them names, such as Mary Pussy and Jane Pussy. These names could be applied by stick-on labels to the toy animals.

Thereafter, having become familiar with the toy animals, the child can proceed to rescue them by first dressing the doll with garment G having side pockets, putting boots on the doll's feet and strapping the back pack on the doll. The doll, so outfitted, is now prepared to undertake the rescue mission in the course of which as toy animals are recovered, they are loaded on the doll until the doll is burdened, front and back, with all of the toy animals.

Various accessories may be provided, such as a miniature baby carriage so that the child can take a stroll with one or more rescued animals. And a miniature playground can be provided including a swing and slide so that the child who has the toy kittens or puppies in her care can show them, as it were, a good time. Another accessory is a small wagon for transporting all of the toy animals and the doll to a play area.

The carrier doll and the toy animals associated with the doll are cast in the roles of principal actors in a drama improvised by the child playing with the doll. And instead of miniature toy animals, these can take a human or humanoid form, such as toy babies or monkeys.

While there has been shown a preferred embodiment of a doll carrier for miniature toy animals in accordance with the application. It will be appreciated that many changes may be made thereon without departing from the spirit of the invention.

I claim:

1. A doll in the form of a human figure, such as a girl, adapted to function as an expandable carrier for two or more of a plurality of miniature toy young animals, such as kittens or puppies; said doll comprising:

A. a pair of stretchable arms joined to shoulders of the doll and extending therefrom; and B. a pair of hands joined to said arms, each hand having a projecting thumb and fingers partially clenched over a palm to define a hook, the hands being joined in opposing relationship to the arms whereby when the hook of one hand is made to intermesh with the hook of the other hand and the hands are then clasped together, the clasped hands in conjunction with the arms create a stretchable cradle which is expandable to securely embrace said two or more of said plurality of toy animals whereby the cradle is capable of securely embracing all of said plurality of animals or a lesser number thereof.

2. A doll as set forth in claim 1, in which the stretchable arms are formed from a tube fabricated of elastomeric yarns and stuffed with a compressible material.

3. A doll as set forth in claim 1, in which the hands are molded of synthetic plastic material.

4. A doll as set forth in claim 1, provided with a garment having a pair of deep pockets on either side thereof below the cradle, said pockets being adapted to accommodate toy animals.

5. A doll as set forth in claim 4, having a pair of feet received in a pair of simulated work boots, said garment being fabricated of a utilitarian material so that the doll appears to be dressed for work.

6. An accessory for a doll as set forth in claim 1, said accessory being a miniature basket having a hoop through which extends an arm of the cradle, the basket accommodating toy animals.

7. An accessory for a doll as set forth in claim 1, said accessory being a miniature back pack having shoulder straps which engage the shoulders of the doll and a deep rear pocket for accommodating toy animals.

8. A doll as set forth in claim 1, in which said toy animals are fabricated of soft compressible material whereby when said two or more animals are embraced by the stretchable cradle, they are then squeezed together.

9. A doll as set forth in claim 8, in which the toy animals each have front and rear legs and a tail, and a body provided with a compressible core.

10. A doll in the form of a human figure, such as a girl, adapted to function as an expandable carrier for two or more of a plurality of miniature toy young animals, such as kittens or puppies; said doll comprising:

A. a pair of stretchable arms joined to shoulders of the doll and extending therefrom; and B. a pair of hands joined to said arms adapted to be clasped together to create in conjunction with the arms a stretchable cradle to securely embrace said two or more of said toy plurality animals whereby the cradle is capable of securely embracing all of said plurality of animals or a lesser number thereof.

* * * * *